US005971262A

United States Patent [19]

Moore et al.

[11] Patent Number: 5,971,262

[45] Date of Patent: Oct. 26, 1999

[54] TAMPER-RESISTANT CONTAINER FOR FRESHLY BAKED FOOD PRODUCTS

[76] Inventors: William E. Moore, 604 Arrowhead Tr., Loveland, Ohio 45140; Dennis E. Moore, 1713 Hoffman Ln., La Grange, Ky. 40031

[21] Appl. No.: 09/019,889

[22] Filed: Feb. 6, 1998

Related U.S. Application Data

[60] Provisional application No. 60/036,958, Feb. 10, 1997.

[51] Int. Cl.[6] ..... B65D 5/00

[52] U.S. Cl. ..... 229/102; 229/120; 229/906; 229/151; 229/154

[58] Field of Search ..... 229/906, 178, 229/152, 151, 154, 102, 120; 426/118

[56] References Cited

U.S. PATENT DOCUMENTS

| | | | |
|---|---|---|---|
| 2,013,299 | 9/1935 | Byrne | 229/102 |
| 2,811,298 | 10/1957 | Jones | 229/120 |
| 4,265,391 | 5/1981 | Zornes et al. | 229/152 |
| 4,511,079 | 4/1985 | Lopez | 229/152 X |

*Primary Examiner*—Stephen P. Garbe
*Assistant Examiner*—Tri M. Mai
*Attorney, Agent, or Firm*—Charles R. Wilson

[57] ABSTRACT

A container embodiment helping to protect freshly baked pizza pie and the like against extremely disgruntled delivery drivers while in a totally unsupervised environment. The container embodiment having tamper-resistant ventilation to enhance the overall effectiveness of a supplemental tamper-resistant securing means which is added just before the delivery process begins. The tamper-resistant ventilation prevents contaminates from being easily injected through the ventilation by a contaminate delivery means without leaving evidence of the contaminates on an inner surface area of the container embodiment.

20 Claims, 5 Drawing Sheets

TAMPER-RESISTANT CONTAINER FOR FRESHLY BAKED FOOD PRODUCTS

This application claims the benefit of U.S. Provisional Application No. 60/036,958 filed Feb. 10, 1997.

BACKGROUND OF THE INVENTION

This invention relates in general to those containerboard containers which are used to house freshly baked pizza pie and the like. More particularly, this invention relates to a containerboard container having tamper-resistant ventilation to enhance the overall effectiveness of a supplemental tamper-resistant securing means which is added just before the delivery process begins.

Most freshly baked pizza pies and the like are prepared in a busy restaurant environment which comprises a plurality of restaurant employees working together in close proximity. It would be very risky for a restaurant employee to tamper with the pizza pie in this busy restaurant environment. In essence, this busy restaurant environment helps to protect the pizza pie until it's picked up by the consumer. However, a growing number of consumers are choosing to have the pizza pie delivered to their location. For economical reasons, most of these deliveries are made by a single delivery driver. Low wages, extremely rude consumers and a multitude of other reasons can cause some delivery drivers to become extremely disgruntled. When the pizza pie leaves the protective environment of the busy restaurant, it enters into an unsupervised environment where it's totally at the mercy of the delivery driver. This unsupervised environment provides an extremely disgruntled delivery driver with an opportunity to purposely contaminate the pizza pie.

The sturdy containers which are used to house freshly baked pizza pie have been around for many years. These prior art containers protect the pizza pie from being easily crushed. These prior art containers are also vented to protect the freshly baked pizza pie from becoming soggy. However, none of these prior art containers protect the pizza pie from being easily contaminated while enroute to the consumer. Simply adding a tamper-resistant securing means to these prior art containers will not prevent the pizza pie from being easily contaminated. A tamper-resistant securing means by itself can be easily bypassed by using a contaminate delivery means, such as a common soda straw to inject contaminates through one of the unprotected vent openings of these prior art containers. An extremely disgruntled delivery driver going to the extreme of purposely contaminating a pizza pie would most likely comprise enough sense not to apply a lethal dose of contamination. This type of extremely disgruntled delivery driver would most likely exercise their contempt for their employer or extremely rude consumers by simply spitting on the pizza pie. A multitude of contaminates could be easily disguised in the greasy appearance of a pizza pie. In fact, it would be extremely difficult to prove that a pizza pie had been purposely contaminated unless the guilty party confessed. It is not being suggested that all delivery drivers becoming extremely disgruntled would go to the extreme of contaminating pizza pies. However, this existing opportunity could be substantially reduced by the container embodiment of the present invention. Therefore, it would be desirable to have a container embodiment which comprises a tamper-resistant securing means to help protect against reopening and tamper-resistant venting to help protect against injection of contaminates from a contaminate delivery means while enroute to the consumer.

SUMMARY OF THE INVENTION

The primary objective of the present invention is to provide a container embodiment having tamper-resistant ventilation to enhance the overall effectiveness of a supplemental tamper-resistant securing means which is added just before the delivery process begins to help protect the freshly baked pizza pie from being easily contaminated.

The primary objective can be accomplished by providing a container embodiment formed from a prescored containerboard container blank. A seal means comprising a strong adhesive is added to the assembled container embodiment before it leaves the busy restaurant environment. The seal means secures the container embodiment in a closed position. The seal means works in conjunction with an obscured manner of venting to prevent the pizza pie from being easily contaminated by an extremely disgruntled delivery driver while enroute to the consumer. The seal means serves as a tamper-resistant securing means by preventing easy reopening of the container embodiment without reopening being evident. The obscured manner of venting serves as a tamper-resistant venting means by venting heated air through elongated passageways formed by various components of the container embodiment. The elongated passageways prevent contaminates from being easily injected through the obscured manner of venting without leaving evidence of the contaminates on an inner surface area of the container embodiment.

To the accomplishment of the above and other related objectives, this invention may be embodied in the form illustrated in the accompanying drawings, attention being called to the fact, however, that the drawings are illustrative only and that changes may be made in the specific construction illustrated and described within the scope of the appended claims.

DESCRIPTION OF THE PREFERRED EMBODIMENTS

Each container embodiment of the present invention is for housing freshly baked pizza pie and the like. Each container embodiment is formed from a prescored containerboard container blank. The scores comprised in each container blank allow various components to be folded. The scores in each container blank are illustrated by dashed lines.

Each container embodiment comprises an obscured manner of venting to help protect the freshly baked pizza pie and the like during such time when the container embodiment comprises a tamper-resistant securing means. The obscured manner of venting prevents contaminates from being easily injected through the obscured manner of venting without leaving evidence of the contaminates on an inner surface area of the container embodiment.

Figure 1:
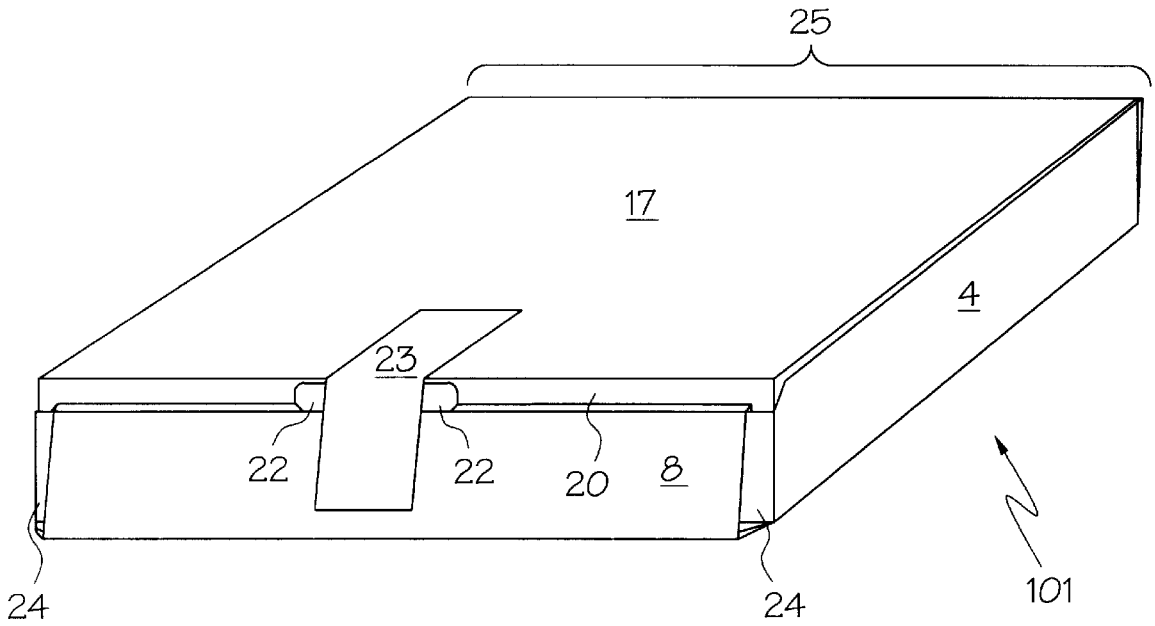
FIG. 1 is an assembled overall view of the first container embodiment of the present invention comprising a seal means being used as a tamper-resistant securing means.

Referring now to FIG. 1, which illustrates the assembled first container embodiment comprising a seal means, designated generally by the reference number 101. This shallow, first container embodiment is formed from the container blank 105 illustrated in FIG. 5.

Figure 5:
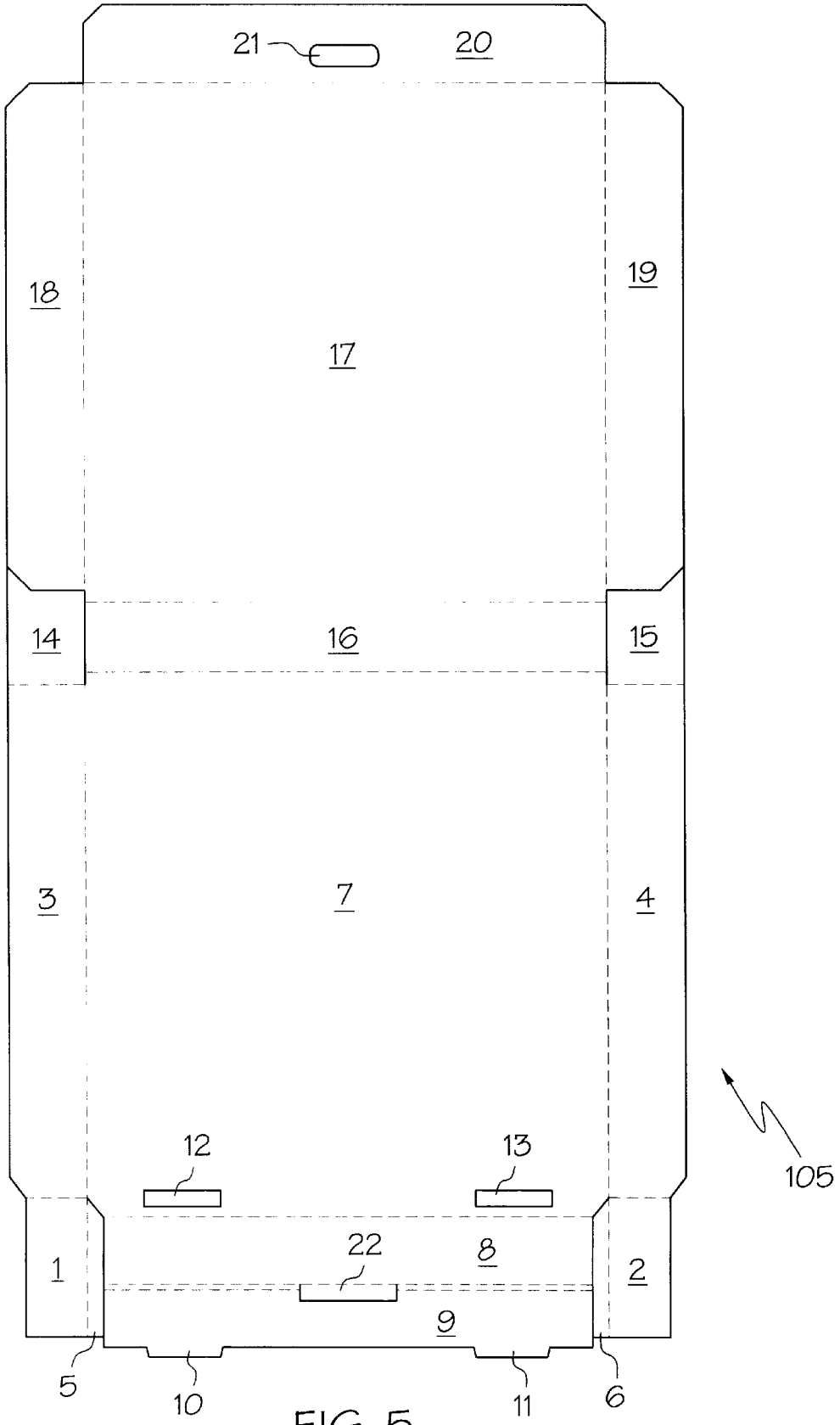
FIG. 5 is a plan view of the first container embodiment.

Referring now to FIG. 5. The container blank 105 comprises a bottom panel 7. The bottom panel comprises an upwardly folding front peripheral wall 8, an upwardly folding back peripheral wall 16 and two opposed upwardly folding side peripheral walls 3, 4. The front edge portion of each side peripheral wall comprises an inwardly folding front flap 1, 2. Each front flap comprises a bottom portion 5, 6 being folded outwardly toward the front peripheral wall. The bottom portions are braced against the bottom panel and the front peripheral wall with the bottom portions positioning the front flaps away from the front peripheral wall. The positioning of the front flaps creates a gap between the front peripheral wall and each front flap. The front peripheral wall comprises an outer portion 9 being folded downwardly over each front flap. Means of securing the front flaps, the outer portion, the front peripheral wall and the side peripheral walls into a standing position includes, tabs 10, 11 extending from the outer portion being secured into openings 12, 13 formed in the bottom panel. A top panel 17 folded downwardly from the top edge portion of the back peripheral wall covers the contents area of the container embodiment. The top panel comprises two opposed downwardly folding side peripheral walls 18, 19 and a downwardly folding front peripheral wall 20. The front peripheral wall and the side peripheral walls of the top panel are inner peripheral walls. The front peripheral wall and the side peripheral walls of the bottom panel are outer peripheral walls. Means of reinforcing the side peripheral walls of the top panel, the side peripheral walls of the bottom panel and the side end portions of the back peripheral wall includes, a back flap 14, 15 folded inwardly from the back edge portion of each side peripheral wall of the bottom panel with each back flap being braced between the top panel and the bottom panel. The reinforcing means also includes, each back flap being braced between the back edge portion of the adjacent side peripheral wall of the top panel and the adjacent side end portion of the back peripheral wall. The close proximity of each back flap reinforces the adjacent side end portion of the back peripheral wall. Each back flap also reinforces the adjacent side peripheral walls by preventing the separation of the adjacent back edge portions.

Figure 2:
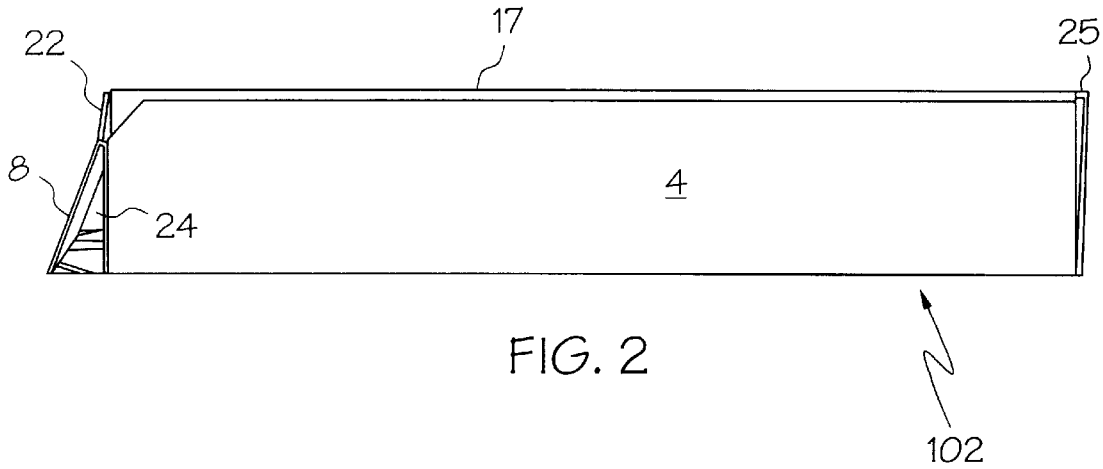
FIG. 2 is an assembled side view of the first container embodiment illustrating its obscured manner of venting.
Figure 3:
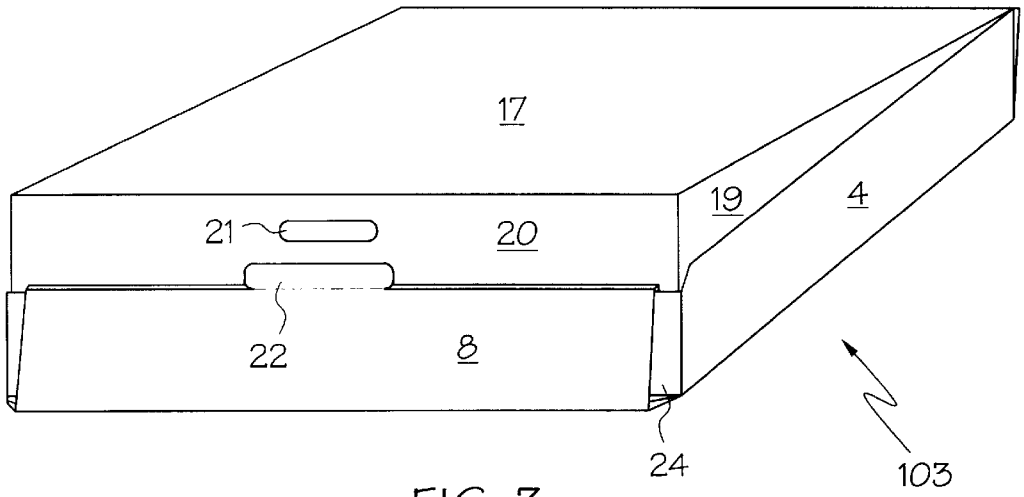
FIG. 3 is an assembled overall view of the first container embodiment with the top panel partially opened illustrating the first of two concealed vent openings.
Figure 4:
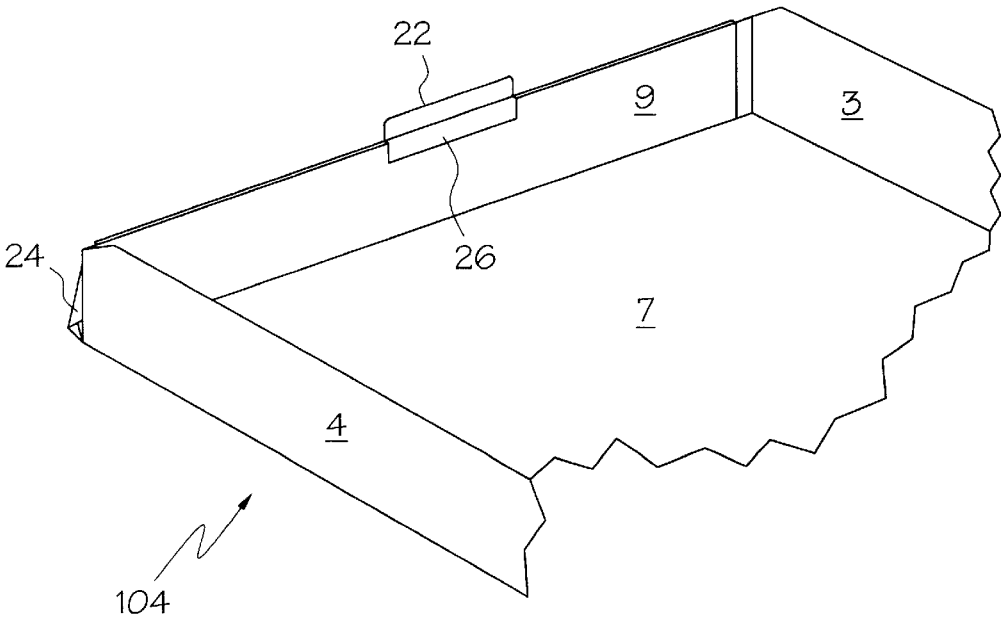
FIG. 4 is an assembled inside view of the bottom front portion of the first container embodiment illustrating the second concealed vent opening.

The first container embodiments, designated generally by the reference numbers 101 in FIG. 1, 102 in FIG. 2, 103 in FIG. 3 and 104 in FIG. 4 illustrate the components forming the obscured manner of venting. A first concealed opening 21 illustrated in FIG. 3, is formed in the front peripheral wall of the top panel. The first concealed opening is aligned with a second concealed opening 26 illustrated in FIG. 4 formed in the outer portion of the front peripheral wall of the bottom panel. The concealed openings allow heated air of the contents area to escape into each venting passageway 24 illustrated in FIG. 1 and FIG. 2. Additional ventilation is provided by the back peripheral wall being slightly angled away from each back flap. The slightly angled back peripheral wall forms a narrow gap 25 illustrated in FIG. 1 and FIG. 2 between each side end portion of the back peripheral wall and the adjacent back flap with each narrow gap serving as a venting passageway.

A seal means 23 illustrated in FIG. 1 comprising a strong adhesive, is secured to the outer surface of the top panel and the outer surface of the front peripheral wall of the bottom panel. The seal means serves as a tamper-resistant securing means for the container embodiment while enroute with the delivery driver. The seal means prevents easy reopening of the container embodiment without reopening being evident. The seal means also serves to further conceal the concealed openings.

An upwardly extending and easily removable tab 22 illustrated in FIG. 3 is notched to the top edge portion of the second concealed opening. The removable tab is positioned below the inner surface of the seal means as illustrated in FIG. 1. The removable tab allows the seal means to be easily broken by pulling outwardly on the exposed ends of the removable tab.

Figure 6:
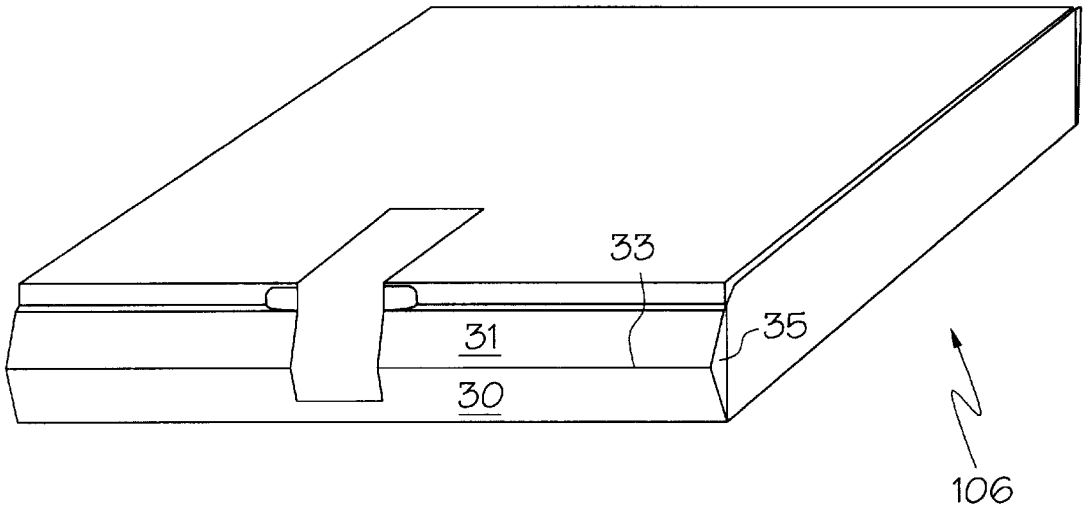
FIG. 6 is an assembled overall view of the second container embodiment comprising a seal means being used as a tamper-resistant securing means.

Referring now to FIG. 6, which illustrates the assembled second container embodiment comprising the same seal means as the first container embodiment, designated generally by the reference number 106. This shallow, second container embodiment is formed from the container blank 108 illustrated in FIG. 8.

It should be noted that just about all of the components comprised in the second container embodiment are the same as those comprised in the first container embodiment and will not again be separately described. Only the different components comprised in the second container embodiment will be described.

Figure 7:
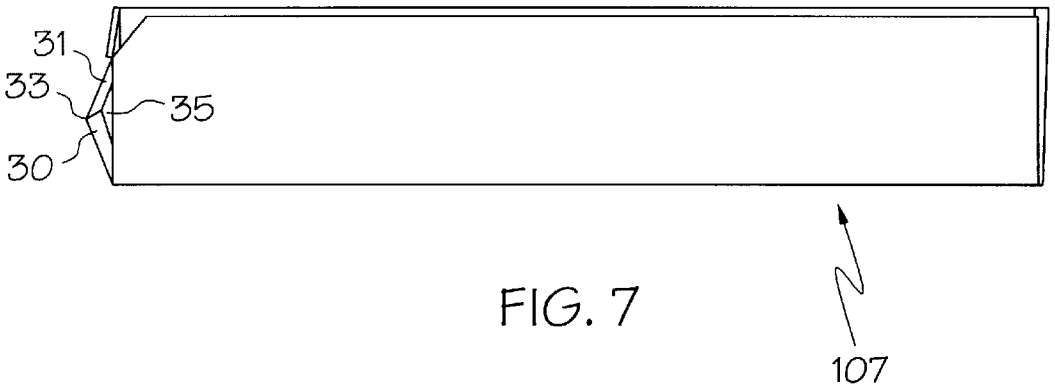
FIG. 7 is an assembled side view of the second container embodiment illustrating its obscured manner of venting.
Figure 8:
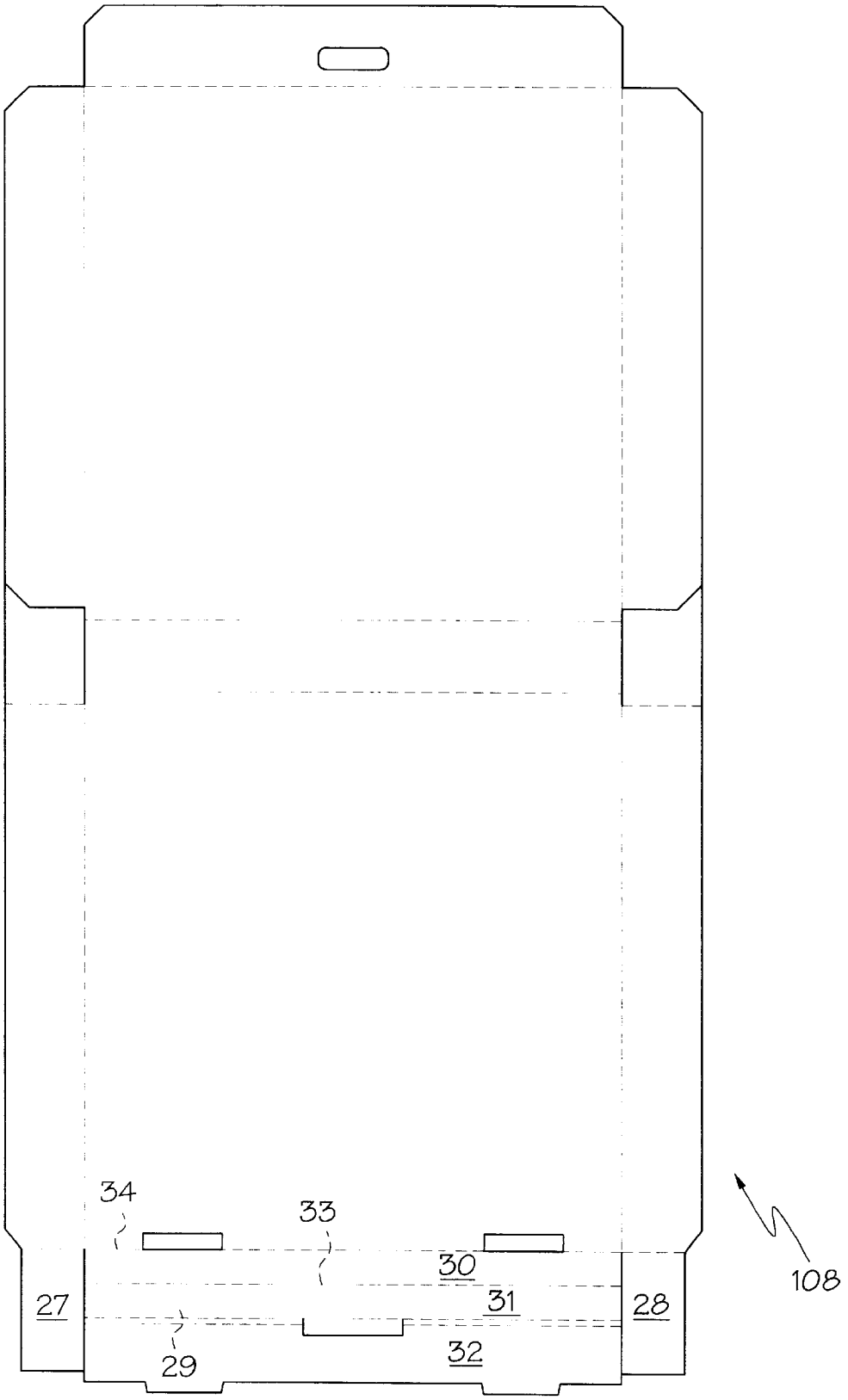
FIG. 8 is a plan view of the second container embodiment.

FIG. 8 illustrates the different components of the second container embodiment. The bottom panel comprises a different upwardly folding front peripheral wall 29. The front peripheral wall 29 has a lower portion 30, an upper portion 31 and an outer portion 32. A horizontal score 33 located between the outer portion 32 and the bottom edge portion 34 of the front peripheral wall 29 forms the lower portion 30 and the upper portion 31. The height of the lower and upper portions 30 and 31 of the unfolded front peripheral wall 29 is greater than the height of the outer portion 32. The front edge portion of each side peripheral wall comprises inwardly folding front flaps 27 and 28. The outer portion 32 of the front peripheral wall 29 is folded downwardly over each of the front flaps 27 and 28. As best seen in FIG. 7, when the front peripheral wall is folded at the horizontal score 33, the lower portion 30 and the upper portion 31 are angled outwardly away from each front flap. The angling reduces the height of the front peripheral wall to the height of the outer portion, which is illustrated by the second container embodiment, designated generally by the reference number 107 in FIG. 7. The angling of the front peripheral wall also creates a gap 35 illustrated in FIG. 6 and FIG. 7 between the front peripheral wall and each front flap with each gap serving as a venting passageway.

It should be understood that the practice of printing the customer receipt onto an adhesive backed label is becoming popular. These labels are being positioned horizontally onto the outer surface of the front peripheral wall of the container. These labels, comprising a strong adhesive, could easily serve as the seal means in each container embodiment of the present invention.

It should also be understood that additional container embodiments of the present invention are possible by eliminating the additional venting passageways formed by the slightly angled back peripheral wall. This could be easily accomplished by increasing the size of the concealed openings.

Additionally, it should be understood that a locking mechanism could be easily constructed into the front peripheral walls of each container embodiment and serve as an alternative tamper-resistant securing means. However, a locking mechanism extending from a front peripheral wall could easily make more difficult the loading of the pizza pie into the container embodiment. A certain amount of dexterity would be required for engaging the locking mechanism. Also, many restaurant employees and consumers could easily damage their fingernails while engaging and disengaging the locking mechanism. Consequently, many restaurant employees and consumers would find a locking mechanism more difficult and less desirable to use than a seal means.

Finally, it should be understood that the primary focus of the present invention is to provide a container embodiment which comprises a safer method for venting when comprising a tamper-resistant securing means. A container comprising only a tamper-resistant securing means could have its contents easily contaminated by a very common item such as a soda straw. The common soda straw could be easily inserted through common venting means and used as a contaminate delivery means while enroute to the customer.

Modifications and variations of the present invention are possible in light of the above teachings. It should be appreciated that the labels applied to each of the components and the order of describing them is arbitrary. Further, the respective sizes illustrated are also examples and many other combinations of sizes of components are possible within the scope of the invention. It is therefore to be understood that within the scope of the appended claims, the invention may be practiced otherwise than as specifically described.

What is claimed is:

1. A shallow container having an obscured manner of venting to help protect freshly baked food contents during such time when said container has a tamper-resistant securing means, said obscured manner of venting preventing contaminates from being easily injected through said venting without leaving evidence of said contaminates on an inner surface area of said container, said container being formed from a prescored containerboard container blank, comprising:

a) a bottom panel comprising a front peripheral wall being folded upwardly, a back peripheral wall being folded upwardly and two opposed side peripheral walls being folded upwardly;

b) front edge portion of each of said side peripheral walls comprising a front flap being folded inwardly, each of said front flaps comprising a bottom portion with each said bottom portion being folded outwardly toward said front peripheral wall, said bottom portions being braced against said bottom panel and said front peripheral wall with said bottom portion positioning each of said front flaps away from said front peripheral wall, said positioning creating a gap between said front peripheral wall and each of said front flaps with each said gap serving as a venting passageway;

c) said front peripheral wall comprising an outer portion being folded downwardly over each of said front flaps;

d) a top panel being folded downwardly from a top edge portion of said back peripheral wall with said top panel covering a contents area of said container, said top panel comprising two opposed side peripheral walls being folded downwardly and a front peripheral wall being folded downwardly; and e) a first concealed opening formed in said front peripheral wall of said top panel, said first concealed opening being aligned with a second concealed opening formed in said outer portion of said front peripheral wall of said bottom panel, said concealed openings allowing heated air of said contents area to escape into each said venting passageway.

2. The container as defined in claim 1, further comprising a tamper-resistant securing means preventing easy reopening of said container without said reopening being evident.

3. The container as defined in claim 1, further wherein:

a) each of said side peripheral walls of said top panel being inner peripheral walls, each of said side peripheral walls of said bottom panel being outer peripheral walls; and b) a back edge portion of each of said side peripheral walls of said bottom panel comprising a back flap being folded inwardly, each of said back flaps being braced between said top panel and said bottom panel, each of said back flaps also being braced between back edge portion of adjacent said side peripheral wall of said top panel and adjacent side end portion of said back peripheral wall, close proximity of each said back flap reinforcing adjacent said side end portion of said back peripheral wall, each said back flap also reinforcing adjacent said side peripheral walls by preventing separation of adjacent said back edge portions; and c) said back peripheral wall being slightly angled away from each said back flap forming a narrow gap between each said side end portion of said back peripheral wall and adjacent said back flap with each said narrow gap serving as a venting passageway.

4. The container as defined in claim 1, further comprising:

a) means of securing each of said front flaps, said outer portion, said front peripheral wall of said bottom panel and each of said side peripheral walls of said bottom panel into a standing position; and b) a tamper-resistant securing means comprising a strong adhesive being secured to outer surface of said top panel and outer surface of said front peripheral wall of said bottom panel, said securing means further concealing said first concealed opening and said second concealed opening, said securing means preventing easy reopening of said container without said reopening being evident.

5. The container as defined in claim 4, wherein an upwardly extending and easily removable tab being notched to top edge portion of said second concealed opening, said removable tab being positioned below inner surface of said securing means allowing said securing means to be easily broken by pulling outwardly on exposed ends of said removable tab.

6. A shallow container having an obscured manner of venting to help protect freshly baked food contents during such time when said container has a tamper-resistant securing means, said obscured manner of venting preventing contaminates from being easily injected through said venting without leaving evidence of said contaminates on an inner surface area of said container, said container being formed from a prescored containerboard container blank, comprising:

a) a bottom panel comprising a front peripheral wall being folded upwardly, a back peripheral wall being folded upwardly and two opposed side peripheral walls being folded upwardly;

b) said front peripheral wall comprising an outer portion, a horizontal score located between said outer portion and a bottom edge portion of said front peripheral wall to form a lower portion and an upper portion, wherein the height of said lower and upper portions of said front peripheral wall before folding being greater than the height of said outer portion;

c) front edge portion of each of said side peripheral walls comprising a front flap being folded inwardly, said outer portion of said front peripheral wall being folded downwardly over each of said front flaps, said lower and upper portions of said front peripheral wall being angled at said horizontal score outwardly away from each of said front flaps, thereby reducing said height of said lower and outer portions of said front peripheral wall to said height of said outer portion and also creating a gap between said front peripheral wall and each of said front flaps with each said gap serving as a venting passageway;

d) a top panel being folded downwardly from a top edge portion of said back peripheral wall with said top panel covering a contents area of said container, said top panel comprising two opposed side peripheral walls being folded downwardly and a front peripheral wall being folded downwardly; and e) a first concealed opening formed in said front peripheral wall of said top panel, said first concealed opening being aligned with a second concealed opening formed in said outer portion of said front peripheral wall of said bottom panel, said concealed openings allowing heated air of said contents area to escape into each said venting passageway.

7. The container as defined in claim 6, further comprising a tamper-resistant securing means preventing easy reopening of said container without said reopening being evident.

8. The container as defined in claim 6, further comprising:

a) said side peripheral walls of said top panel being inner peripheral walls, said side peripheral walls of said bottom panel being outer peripheral walls;

b) back edge portion of each said side peripheral wall of said bottom panel comprising a back flap being folded inwardly, each said back flap being braced between said top panel and said bottom panel, each said back flap also being braced between back edge portion of adjacent said side peripheral wall of said top panel and adjacent side end portion of said back peripheral wall, close proximity of each said back flap reinforcing adjacent said side end portion of said back peripheral wall, each said back flap also reinforcing adjacent said side peripheral walls by preventing separation of adjacent said back edge portions; and c) said back peripheral wall being slightly angled away from each said back flap forming a narrow gap between each said side end portion of said back peripheral wall and adjacent said back flap with each said narrow gap serving as a venting passageway.

9. The container as defined in claim 6, further comprising:

a) means of securing said front flaps, said outer portion, said front peripheral wall of said bottom panel and each of said side peripheral walls of said bottom panel into a standing position; and b) a tamper-resistant securing means comprising a strong adhesive being secured to outer surface of said top panel and outer surface of said upwardly folded front peripheral wall of said bottom panel, said securing means further concealing said first concealed opening and said second concealed opening, said securing means preventing easy reopening of said container without said reopening being evident.

10. The container as defined in claim 9, wherein an upwardly extending and easily removable tab being notched to top edge portion of said second concealed opening, said removable tab being positioned below inner surface of said securing means allowing said securing means to be easily broken by pulling outwardly on exposed ends of said removable tab.

11. A shallow container having an obscured manner of venting to help protect freshly baked food contents, said obscured manner of venting preventing contaminates from being easily injected through said venting without leaving evidence of said contaminates on an inner surface area of said container, said container being formed from a prescored containerboard container blank, comprising:

a) a bottom panel comprising a front peripheral wall being folded upwardly, a back peripheral wall being folded upwardly and two opposed side peripheral walls being folded upwardly;

b) front edge portion of each of said side peripheral walls comprising a front flap being folded inwardly, each of said front flaps comprising a bottom portion with each said bottom portion being folded outwardly toward said front peripheral wall, said bottom portions being braced against said bottom panel and said front peripheral wall with said bottom portion positioning each of said front flaps away from said front peripheral wall, said positioning creating a gap between said front peripheral wall and each of said front flaps with each said gap serving as a venting passageway;

c) said front peripheral wall comprising an outer portion being folded downwardly over each of said front flaps;

d) means of securing said front flaps, said outer portion, said front peripheral wall and each of said side peripheral walls into a standing position;

e) a top panel being folded downwardly from a top edge portion of said back peripheral wall with said top panel covering contents area of said container, said top panel comprising two opposed side peripheral walls being folded downwardly and a front peripheral wall being folded downwardly;

f) said front peripheral wall and each of said side peripheral walls of said top panel being inner peripheral walls, said front peripheral wall and each of said side peripheral walls of said bottom panel being outer peripheral walls; and g) a first concealed opening formed in said front peripheral wall of said top panel, said first concealed opening being aligned with a second concealed opening formed in said outer portion of said front peripheral wall of said bottom panel, said concealed openings allowing heated air of said contents area to escape into each said venting passageway.

12. The container as defined in claim 11, further comprising a tamper-resistant securing means preventing easy reopening of said container without said reopening being evident.

13. The container as defined in claim 11, further comprising:

a) back edge portion of each said side peripheral wall of said bottom panel comprising a back flap being folded inwardly, each said back flap being braced between said top panel and said bottom panel, each said back flap also being braced between back edge portion of adjacent said side peripheral wall of said top panel and adjacent side end portion of said back peripheral wall, close proximity of each said back flap reinforcing adjacent said side end portion of said back peripheral wall, each said back flap also reinforcing adjacent said side peripheral walls by preventing separation of adjacent said back edge portions; and b) said back peripheral wall being slightly angled away from each said back flap forming a narrow gap between each said side end portion of said back peripheral wall and adjacent said back flap with each said narrow gap serving as a venting passageway.

14. The container as defined in claim 11, further comprising a tamper-resistant securing means comprising a strong adhesive being secured to outer surface of said top panel and outer surface of said front peripheral wall of said bottom panel, said securing means further concealing said first concealed opening and said second concealed opening, said securing means preventing easy reopening of said container without said reopening being evident.

15. The container as defined in claim 14, wherein an upwardly extending and easily removable tab being notched to top edge portion of said second concealed opening, said removable tab being positioned below inner surface of said securing means allowing said securing means to be easily broken by pulling outwardly on exposed ends of said removable tab.

16. A shallow container having an obscured manner of venting to help protect freshly baked food contents, said obscured manner of venting preventing contaminates from being easily injected through said venting without leaving evidence of said contaminates on an inner surface area of said container, said container being formed from a prescored containerboard container blank, comprising:

a) a bottom panel comprising a front peripheral wall being folded upwardly, a back peripheral wall being folded upwardly and two opposed side peripheral walls being folded upwardly;

b) said front peripheral wall having an outer portion attached thereto, a horizontal score located between said outer portion and a bottom edge portion of said front peripheral wall to form a lower portion and an upper portion, height of said lower and upper portions of said front peripheral wall before folding being greater than height of said outer portion;

c) front edge portion of each of said side peripheral walls comprising a front flap being folded inwardly, said outer portion of said front peripheral wall being folded downwardly over each of said front flaps, said front peripheral wall angled at said horizontal score outwardly away from each of said front flaps, thereby reducing said height of said lower and upper portions of said front peripheral wall to said height of said outer portion, and also creating a gap between said front peripheral wall and each of said front flaps with each said gap serving as a venting passageway;

d) means of securing said front flaps, said outer portion, said front peripheral wall and each of said side peripheral walls into a standing position;

e) a top panel being folded downwardly from a top edge portion of said back peripheral wall with said top panel covering contents area of said container, said top panel comprising two opposed side peripheral walls being folded downwardly and a front peripheral wall being folded downwardly;

f) said front peripheral wall and each of said side peripheral walls of said top panel being inner peripheral walls, said front peripheral wall and each of said side peripheral walls of said bottom panel being outer peripheral walls; and g) a first concealed opening formed in said front peripheral wall of said top panel, said first concealed opening being aligned with a second concealed opening formed in said outer portion of said front peripheral wall of said bottom panel, said concealed openings allowing heated air of said contents area to escape into each said venting passageway.

17. The container as defined in claim 16, further comprising a tamper-resistant securing means preventing easy reopening of said container without said reopening being evident.

18. The container as defined in claim 16, further comprising:

a) back edge portion of each said side peripheral wall of said bottom panel comprising a back flap being folded inwardly, each said back flap being braced between said top panel and said bottom panel, each said back flap also being braced between back edge portion of adjacent said side peripheral wall of said top panel and adjacent side end portion of said back peripheral wall, close proximity of each said back flap reinforcing adjacent said side end portion of said back peripheral wall, each said back flap also reinforcing adjacent said side peripheral walls by preventing separation of adjacent said back edge portions; and b) said back peripheral wall being slightly angled away from each said back flap forming a narrow gap between each said side end portion of said back peripheral wall and adjacent said back flap with each said narrow gap serving a venting passageway.

19. The container as defined in claim 16, wherein a securing means comprising a strong adhesive being secured to outer surface of said top panel and outer surface of said front peripheral wall of said bottom panel, said securing means further concealing said first concealed opening and said second concealed opening, said securing means preventing easy reopening of said container without said reopening being evident.

20. The container as defined in claim 19, wherein an upwardly extending and easily removable tab being notched to top edge portion of said second concealed opening, said removable tab being positioned below inner surface of said securing means allowing said securing means to be easily broken by pulling outwardly on exposed ends of said removable tab.

* * * * *